US005971704A

United States Patent [19]

Blattmann

[11] Patent Number: 5,971,704

[45] Date of Patent: Oct. 26, 1999

[54] DEVICE FOR ADJUSTING THE RUNNING CLEARANCE OF AN IMPELLER

[75] Inventor: Urs J. Blattmann, Garibaldi Highlands, Canada

[73] Assignee: Toyo Pumps North America Corporation, Burnaby, Canada

[21] Appl. No.: 08/844,984

[22] Filed: Apr. 23, 1997

[51] Int. Cl.[6] ..... F04D 29/08

[52] U.S. Cl. ..... 415/173.2; 415/173.3; 415/174.1

[58] Field of Search ..... 415/173.2, 170.1, 415/172.1, 173.3, 174.1, 174.3

[56] References Cited

U.S. PATENT DOCUMENTS

| | | | |
|---|---|---|---|
| 531,074 | 12/1894 | Wagner . | |
| 1,114,238 | 10/1914 | Doble . | |
| 1,891,267 | 12/1932 | Milkowski . | |
| 3,101,671 | 8/1963 | Schroeder | 103/103 |
| 3,169,485 | 2/1965 | Sadler | 103/4 |
| 3,324,800 | 6/1967 | Schroeder | 103/114 |
| 3,490,685 | 1/1970 | Ferri | 230/132 |
| 3,754,834 | 8/1973 | Wolters | 415/110 |
| 3,779,667 | 12/1973 | Johnson | 415/172.1 |
| 4,406,465 | 9/1983 | Rockwood et al. | 277/96.1 |
| 4,439,096 | 3/1984 | Rockwood et al. | 415/174.3 |
| 4,527,948 | 7/1985 | Addie | 415/128 |
| 4,913,619 | 4/1990 | Haentjens et al. | 415/172.1 |
| 5,116,197 | 5/1992 | Snell | 415/126 |
| 5,195,867 | 3/1993 | Stirling | 415/111 |
| 5,295,786 | 3/1994 | Kajiwara | 415/172.1 |

FOREIGN PATENT DOCUMENTS

| | | |
|---|---|---|
| 4022095A1 | 7/1991 | Germany . |
| 2203491 | 10/1988 | United Kingdom . |
| WO 96/27085 | 9/1996 | WIPO . |

OTHER PUBLICATIONS

New Pump for Pulp and Paper Industry, World Pumps, No. 307, Apr. 1, 1992 p. 10—XP000271012.

*Primary Examiner*—F. Daniel Lopez
*Assistant Examiner*—Richard Woo
*Attorney, Agent, or Firm*—Seed and Berry LLP

[57] ABSTRACT

An improved device for adjusting the running clearance of a pump impeller is shown and described. In a preferred embodiment, an annular adjustment member is positioned adjacent to a pump impeller and the pump housing, the impeller being spaced from the adjustment member and housing by a predetermined distance. The adjustment member is selectively moved towards and away from the impeller, and lockable in any desired position. The adjustment member is moved in an axial direction by loosening a plurality of clamp nuts, and turning adjustment nuts until the annular adjustment member bottoms out on the impeller. The annular adjustment member is then backed off until an end surface of the adjustment member is spaced from the end surface of the impeller by the predetermined distance. The adjustment member is locked in the new location, thereby resetting the running clearance of the pump. The annular adjustment member includes an elastomeric member that creates a dynamic seal in a radial direction, the adjustment member being accessible and usable during operation of the pump.

10 Claims, 3 Drawing Sheets

DEVICE FOR ADJUSTING THE RUNNING CLEARANCE OF AN IMPELLER

TECHNICAL FIELD

This invention relates to centrifugal pumps, and more particularly, to a device for adjusting the running clearance of a pump impeller.

BACKGROUND OF THE INVENTION

Prior to operation of a pump, the impeller is spaced from the pump casing by a predetermined distance, commonly referred to as the running clearance. During operation of the pump, the suction side of the pump casing assembly, as well as the adjacent face of the pump impeller, are subject to abrasive wear. As a result of this wear on the impeller face and pump casing, the running clearance becomes larger after operation of the pump. However, as the running clearance increases, increased turbulence accelerates the erosion and wear on the impeller and pump casing, and suction performance is reduced. As a result, pump performance deteriorates resulting in higher power consumption, and the accelerated wear causes the impeller and pump casing to wear out prematurely. It is therefore important to maintain the running clearance at a selected distance.

Currently available devices for adjusting the running clearance of a pump have several disadvantages. For example, some systems require the pump to be shut down and the drive gear disassembled in order to make the adjustment. Depending on the size of a pump, this procedure can take anywhere from several hours to two days, during which time the pump is off-line, resulting in a loss of production. Other adjustment devices use mechanisms whose performance will deteriorate and ultimately cease when subjected to media containing solid particles, which is a common operating condition. Other currently available adjustment devices produce a gap between the intake liner and casing while making the adjustment, resulting in the problems discussed above, namely, severe turbulence, possible cavitation, and accelerated erosion.

A need therefore exists for an improved device for adjusting the running clearance of a pump impeller. The present invention fulfills this need, and provides further related advantages.

SUMMARY OF THE INVENTION

Briefly, the present invention provides an improved device for adjusting the running clearance of a pump impeller. In a preferred embodiment, the device includes an adjustment member positioned adjacent to the pump housing and to the impeller. Initially, an end surface of the impeller is spaced from an end surface of the housing by a predetermined distance. The adjustment member is selectively movable in an axial direction towards the impeller, the adjustment member having a locking member for securing the adjustment member in a desired position, such that the end surface of the impeller is spaced from an end surface of the adjustment member by the predetermined distance.

In a preferred embodiment, the adjustment member includes an annular wear ring and an annular bushing coupled to opposing sides of an elastomeric member, the elastomeric member forming a dynamic seal with the housing during operation of the pump. The adjustment member is provided on a shaft, a clamp nut provided on the shaft on one side of the adjustment member, and an adjustment nut provided on the shaft on the opposite side of the adjustment member.

In a preferred embodiment, the adjustment is made by loosening the clamp nut and turning the adjustment nut until the adjustment member touches the impeller. The adjustment nut is scaled such that one complete turn in the opposite direction retracts the end surface of the adjustment member from the impeller by the predetermined distance. The clamp nut is then tightened and the predetermined running clearance is now reestablished between the end surface of the impeller and the end surface of the adjustment member. In a preferred embodiment, the adjustment member is positioned around an outer circumference of the intake liner such that the adjustment member is shielded from the pump interior. However, the clamp and adjustment nuts are exposed to the atmosphere, and are therefore easily accessed.

DETAILED DESCRIPTION OF THE INVENTION

Figure 1:
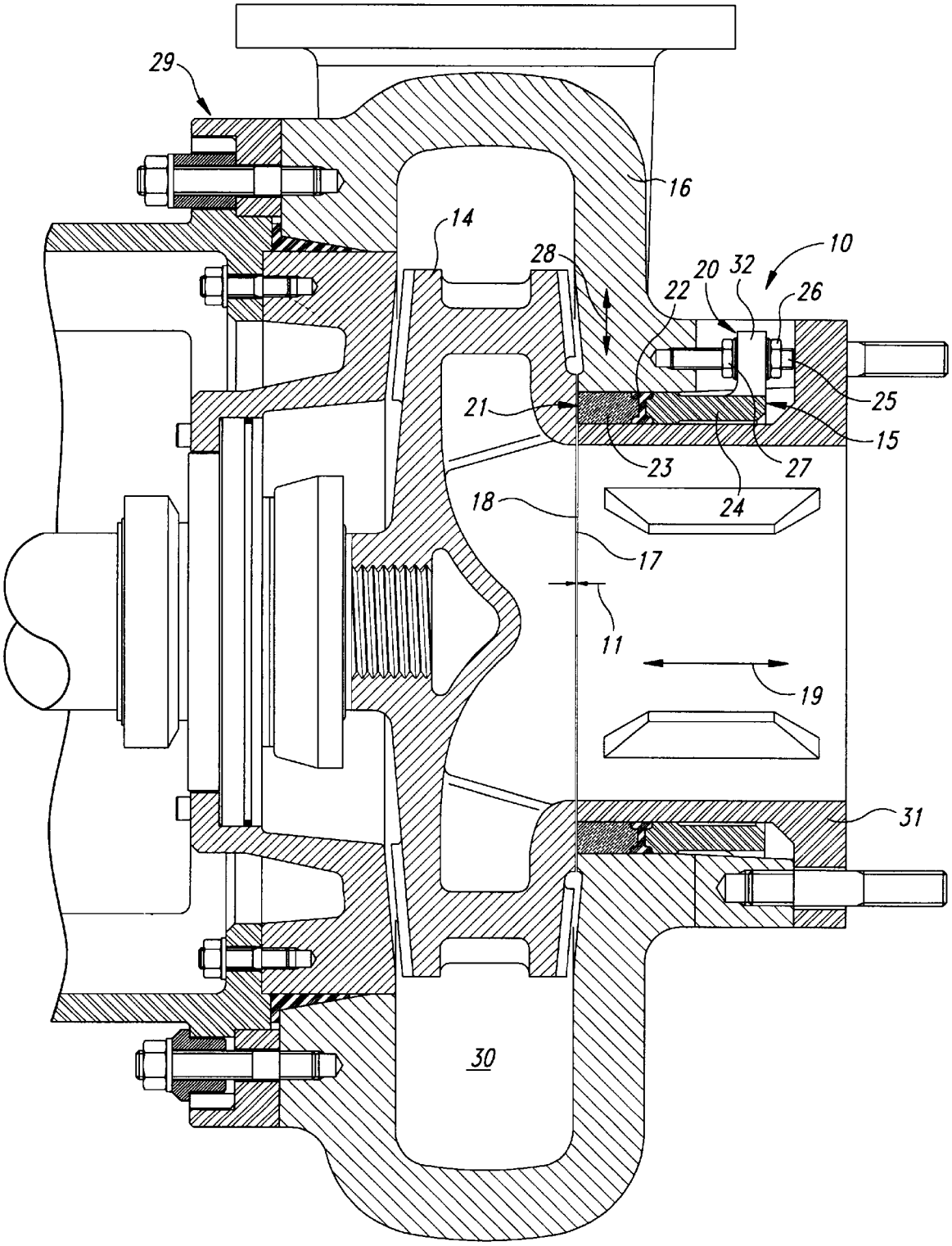
FIG. 1 is a cross-sectional elevational view of an adjustment device provided in accordance with a preferred embodiment of the present invention, installed in a pump.

An improved device 10 for adjusting the running clearance 11 of a pump impeller 14 is provided in accordance with a preferred embodiment of the present invention. As illustrated in FIG. 1, the device has an adjustment member 15, having an annular wear ring 23 and an annular bushing 24 coupled to opposite sides of an elastomeric member 22. The adjustment member 15 has a plurality of flanges 32, each flange being provided on a shaft 25. The adjustment member 15 is slideably movable along the shafts 25, in an axial direction illustrated by reference arrow 19 towards and away from the impeller 14. As further illustrated in FIGS. 1–3, the adjustment member 15 includes a locking member 20, comprised of a first adjustment nut 26 and a second clamp nut 27 provided on each shaft 25, on opposing sides of each flange 32.

In a preferred embodiment, the annular adjustment member is positioned around an outer circumference of the intake liner 31, an end surface 21 of the adjustment member 15 being flush with an end surface 18 of the intake liner. As illustrated in FIG. 1, prior to and during initial operation of the pump, an end surface 17 of impeller 14 is spaced from the end surface 18 of the intake liner 31 and the end surface 21 of adjustment member 15 by a predetermined distance or running clearance 11.

Figure 2:
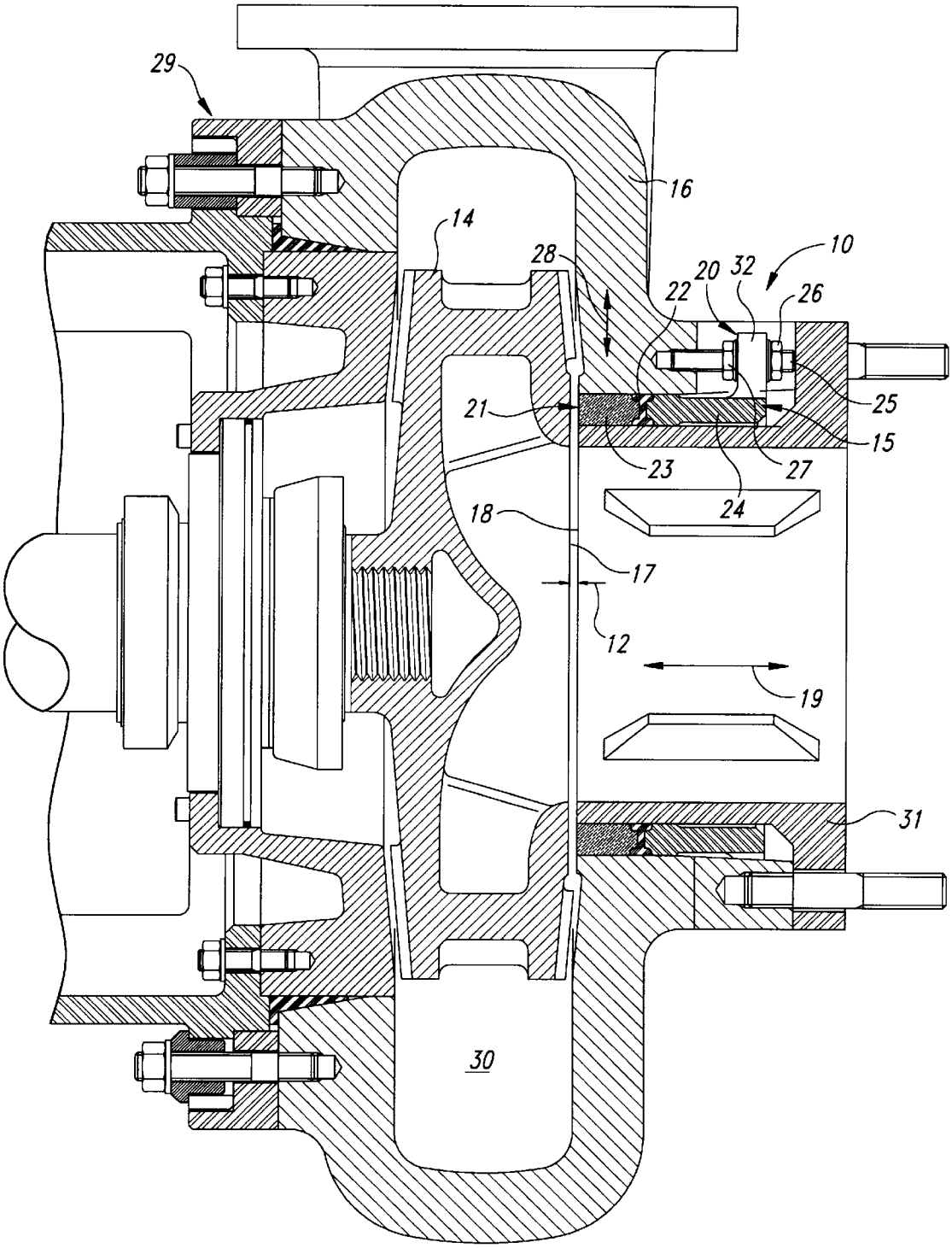
FIG. 2 is a cross-sectional elevational view of the apparatus illustrated in FIG. 1, shown after a period of operation.

After the pump 29 has operated for a period of time, the impeller 14 and pump casing 16, including intake liner 31, are subject to abrasive wear. Therefore, as illustrated in FIG. 2, the running clearance 12 after operation of the pump is greater than the initial running clearance 11. When this occurs, the efficiency of the pump is reduced, and power consumption increases. Therefore, the power consumption is monitored, and an adjustment is made in accordance with a preferred embodiment of the present invention when the power consumption exceeds a selected value.

Figure 3:
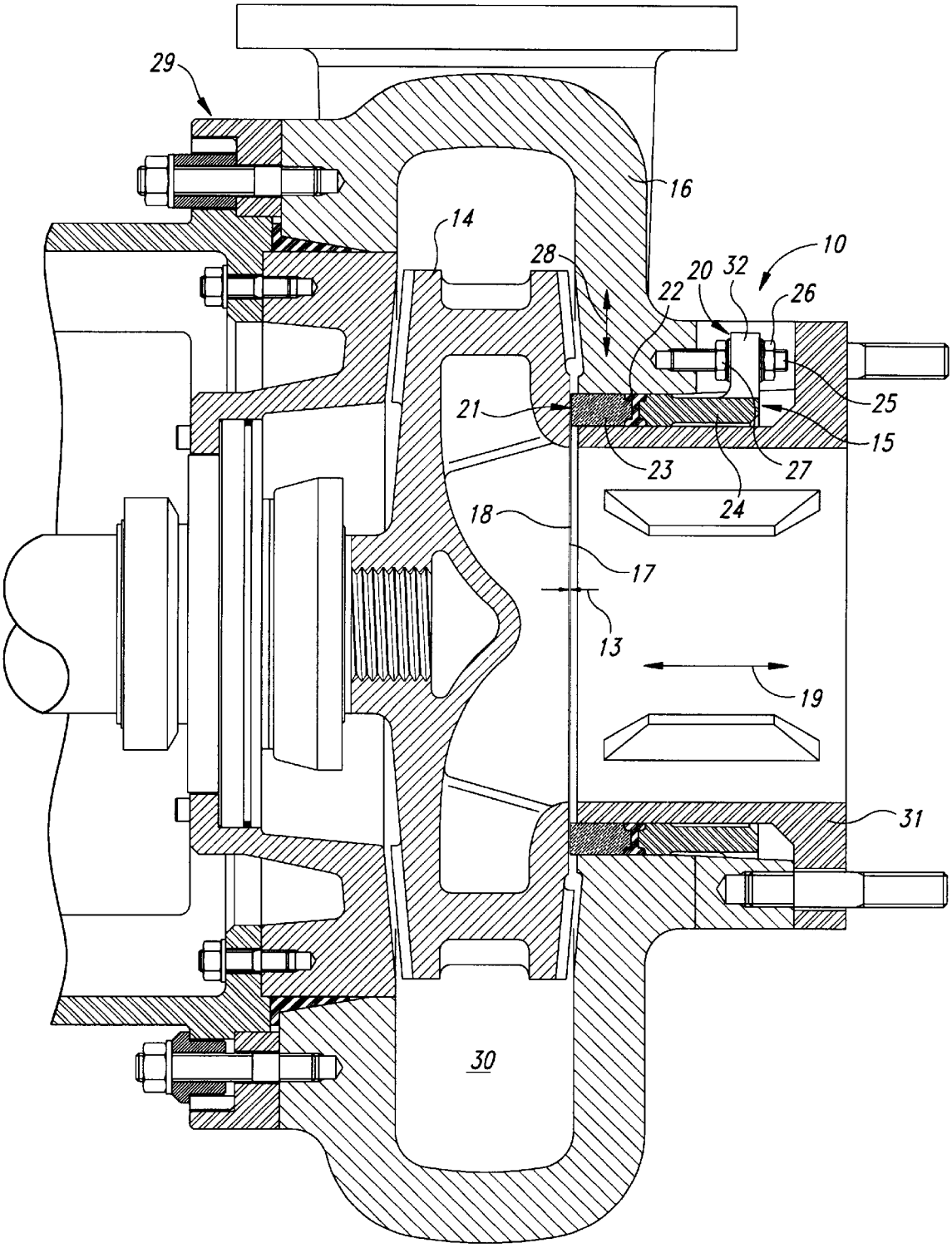
FIG. 3 is a cross-sectional elevational view of the apparatus illustrated in FIG. 1, shown after an adjustment of the running clearance has been made.

In order to adjust the running clearance, the clamp nuts 27 are loosened, and the adjustment nuts 26 are rotated, thereby advancing the adjustment member 15 along shaft 25 until the end surface of the adjustment member bottoms out on the end surface 17 of impeller 14. The adjustment member 15 is then moved in the opposite direction away from impeller 14, until the end surface 17 of impeller 14 is spaced from the end surface 21 of adjustment member 15 by the preselected distance 13, which is equivalent to the initial running clearance 11. The adjustment member is then secured in this desired position, by tightening the clamp nuts 27. In a preferred embodiment, the adjustment nut 26 is scaled such that one complete turn will back the adjustment member off from the impeller by the predetermined distance. As illustrated in FIG. 3, the initial running clearance is thereby reestablished between the impeller 14 and the annular wear ring 23 of the adjustment member, and the pump is in its normal operating state.

The adjustment device of the present invention provides several advantages over currently available devices. The elastomeric member 22 is compressed by the internal pressure of the pump acting on the annular wear ring 23, thus forming a dynamic seal in the radial direction 28 between the casing 16 and intake liner 31. More particularly, the tightness of the seal increases as the pump internal pressure increases, resulting in a dynamic, uniform pressurization of the elastomer, which allows the device to seal, even when moved from its original position onto a contaminated, rough surface. The adjustment of the running clearance may therefore be made during operation of the pump, given that the adjustment member 15 is sealed in the radial direction, yet is moved in an axial direction. Furthermore, the adjustment member 15 is shielded from the pump interior by the intake liner 31. However, the first and second nuts 26 and 27 are exposed to the environment, and are therefore easily accessed and adjusted during pump operation.

It will be understood that the number of flanges 32 and corresponding shafts 25 will vary depending on the size of the pump. Although the elastomeric member 22, annular wear ring 23 and annular bushing 24 may be made of a variety of materials, in a preferred embodiment, the elastomeric member 22 is made of a fluor-elastomer, the annular wear ring 23 is made of silicon carbide, and the annular bushing 24 is made of stainless steel. Alternative materials for the annular wear ring 23 include tungsten carbide or abrasion resistant high chromium iron. In a preferred embodiment, the wear ring 23 and bushing 24 are mechanically connected to the elastomeric member 22, for example, by being vulcanized to the elastomeric member 22.

A device for adjusting the running clearance of a pump impeller has been shown and described. From the foregoing, it will be appreciated that although embodiments of the invention have been described herein for purposes of illustration, various modifications may be made without deviating from the spirit of the invention. Thus, the present invention is not limited to the embodiments described herein, but rather is defined by the claims which follow.

I claim:

1. A device for adjusting the running clearance of an impeller comprising:

an adjustment member positioned adjacent to a housing and to an impeller, an end surface of the impeller being spaced from an end surface of the housing by a predetermined distance, the adjustment member being selectively movable in an axial direction towards the impeller, the adjustment member having a locking member for securing the adjustment member in a desired position such that the end surface of the impeller is spaced from an end surface of the adjustment member by a predetermined distance, and the adjustment member has an elastomeric member that forms a dynamic seal with the housing which seal will automatically expand radially from axial movement of the wear ring to increase seal pressure with increases in pressure within the pump housing acting on the wear ring.

2. The device according to claim 1 wherein the adjustment member comprises an annular wear ring and an annular bushing wherein the elastomeric member is located between the wear ring and bushing so that pressure on the wear ring will expand the elastomeric member radially to create said dynamic seal.

3. The device according to claim 1 wherein the adjustment member is provided on a shaft, the adjustment member being slidably movable on the shaft, and wherein first and second nuts are positioned on the shaft on opposing sides of the adjustment member, such that when the first and second nuts are loosened, the adjustment member is moved towards the impeller until the adjustment member is spaced from the impeller by the predetermined distance, the adjustment member being locked in the desired position by tightening the first and second nuts.

4. The device according to claim 3 wherein the adjustment member is advanced until it touches the impeller, and the first nut is scaled such that one full turn of the first nut will cause the adjustment member to retract from the impeller by the predetermined distance.

5. The device according to claim 3 wherein the first and second nuts are exposed externally of the housing and are therefore easily accessed.

6. The device according to claim 1 wherein the annular adjustment member is provided with a plurality of flanges, each flange being positioned on a shaft with a clamp nut positioned on the shaft below the flange and an adjustment nut positioned on the shaft above the flange, the clamp nut being selectively loosened and tightened, the annular adjustment member being selectively moved in an axial direction toward and away from the impeller by turning the adjustment nut.

7. A device for adjusting the running clearance of an impeller comprising:

an annular adjustment member having an annular wear ring and positioned in a pump casing adjacent to an end surface of an impeller, the wear ring having an inner face facing the impeller and an opposite outer face, the annular adjustment member being coupled to a shaft such that the annular adjustment member is movable along the shaft in an axial direction towards the impeller, the annular adjustment member being securable on the shaft at a selected location such that the end surface of the impeller is spaced from the inner face of the annular wear ring of the adjustment member by a predetermined distance, the annular adjustment member having an annular elastomeric member coupled to the wear ring outer face to move in unison with the annular adjustment member which forms a seal with the housing in a radial direction during operation of the pump.

8. The device according to claim 7 wherein the adjustment member is provided on a shaft, the adjustment member being slidably movable on the shaft, and wherein a first nut and a second nut are positioned on the shaft on opposing sides of the adjustment member, such that when the first and second nuts are loosened, the adjustment member is moved towards the impeller until the adjustment member is spaced from the impeller by the predetermined distance, the adjustment member being locked in the desired position by tightening the first and second nuts.

9. The device according to claim 8 wherein the adjustment member is advanced until it touches the impeller, and the first nut is scaled such that one full turn of the first nut will cause the adjustment member to retract from the impeller by the predetermined distance.

10. A centrifugal pump comprising:

an impeller rotatable about an axis, said impeller having a suction side and a gland side;

a static volute, said impeller being adapted to rotate inside said static volute; and sealing means adapted to reduce or substantially eliminate the clearance between the surface of the suction side of said impeller and said static volute; wherein said sealing means are axially adjustable and are expandable in a radial direction with increases in pressure adjacent the impeller.

* * * * *